US010823366B2

(12) United States Patent
Hawks et al.

(10) Patent No.: US 10,823,366 B2
(45) Date of Patent: Nov. 3, 2020

(54) LUMINAIRE LENS AND HOUSING SYSTEM

(71) Applicant: Optic Arts, Inc., Monterey Park, CA (US)

(72) Inventors: David Hawks, Norrthridge, CA (US); Mason Barker, Alhambra, CA (US)

(73) Assignee: Optic Arts, LLC, Monterey Park, CA (US)

( * ) Notice: Subject to any disclaimer, the term of this patent is extended or adjusted under 35 U.S.C. 154(b) by 0 days.

(21) Appl. No.: 15/920,625

(22) Filed: Mar. 14, 2018

(65) Prior Publication Data

US 2019/0285244 A1 Sep. 19, 2019

(51) Int. Cl.

| | |
|---|---|
| ***F21V 3/02*** | (2006.01) |
| ***F21V 3/06*** | (2018.01) |
| ***F21S 4/22*** | (2016.01) |
| ***F21V 17/12*** | (2006.01) |
| ***F21V 21/26*** | (2006.01) |
| *F21Y 103/10* | (2016.01) |
| *F21Y 115/10* | (2016.01) |

(52) U.S. Cl.

CPC ..... *F21V 3/02* (2013.01); *F21S 4/22* (2016.01); *F21V 3/062* (2018.02); *F21V 17/12* (2013.01); *F21V 21/26* (2013.01); *F21Y 2103/10* (2016.08); *F21Y 2115/10* (2016.08)

(58) Field of Classification Search

CPC . F21V 3/02; F21V 3/062; F21V 17/12; F21V 21/26; F21S 4/22; F21Y 2103/10; F21Y 2115/10

USPC ..... 362/225

See application file for complete search history.

(56) References Cited

U.S. PATENT DOCUMENTS

| | | | |
|---|---|---|---|
| 6,074,074 | A | 6/2000 | Marcus |
| 7,815,338 | B2 | 10/2010 | Siemiet et al. |
| 8,827,505 | B1 | 9/2014 | Senkyr et al. |

(Continued)

FOREIGN PATENT DOCUMENTS

WO 2016008029 A1 1/2016

OTHER PUBLICATIONS

Diodeled, Tapeguard LED Tape Light Cover, https://www.diodeled.com/tapeguard-led-cover.html.

(Continued)

*Primary Examiner* — Cara E Rakowski
*Assistant Examiner* — Jessica M Apenteng
(74) *Attorney, Agent, or Firm* — Saul Ewing Arnstein & Lehr LLP

(57) ABSTRACT

The present technology is a luminaire lens and housing system for mechanically fastening of a light strip to a luminaire housing via a lens body. The system can include a luminaire housing formed from extruded modular luminaire housing sections assembled together, a mounting bracket mountable to the housing sections, and a lens body mountable to the mounting bracket. The mounting bracket includes a generally U-shape configuration capable of receiving the light strip and the lens body. The lens body can be a flexible polymeric lens of continuous length for the entire length of the luminaire housing. An interior section of the lens body includes legs receivable in depressions defined in the mounting bracket for retention thereof. The lens body is configured to contact and apply mechanical pressure to the light strip thereby securing the light strip in the mounting bracket or in the luminaire housing.

18 Claims, 5 Drawing Sheets

(56) References Cited

U.S. PATENT DOCUMENTS

| | | | | |
|---|---|---|---|---|
| 9,115,858 | B2 | 8/2015 | Levante et al. | |
| 9,546,781 | B2 | 1/2017 | Myers | |
| 9,565,769 | B2 | 2/2017 | Dankelmann et al. | |
| 2003/0048641 | A1* | 3/2003 | Alexanderson | F21V 29/004 362/470 |
| 2014/0268727 | A1* | 9/2014 | Amrine, Jr. | F21K 9/17 362/224 |
| 2015/0260376 | A1* | 9/2015 | Joo | F21V 5/007 362/235 |
| 2016/0138768 | A1 | 5/2016 | Greene | |
| 2016/0169481 | A1* | 6/2016 | Horvath | F21V 13/04 362/223 |
| 2017/0038036 | A1 | 2/2017 | Guerrieri | |

OTHER PUBLICATIONS

Inventables, Light Diffuser Film Rolls, https://www.inventables.com/technologies/light-diffuser-film-rolls.

Microsharp, New Lenticular Diffuser Film Launched, http://www.microsharp.co.uk/index.php/news/180- new-lenticular-diffuser-film-launched.html.

* cited by examiner

LUMINAIRE LENS AND HOUSING SYSTEM

BACKGROUND

Technical Field

The present technology relates to a luminaire fixture and lens body. More particularly, the present technology relates to a luminaire lens and housing system for use in connection with mechanical fastening of a light emitting diode (LED) tape, strip or engine to a light fixture housing using a lens body.

Description of the Prior Art

The use of light lens cover assemblies, LED engines fixtures and LED lighting systems are in common use today and are known in the prior art. When compared against incandescent and fluorescent lighting systems, LED lighting systems offer improved electrical efficiency and come in a variety of lengths, shapes, arrays and configurations. Such lights incorporate lenses, reflectors, phosphors, and diffusers that influence the size, shape, and appearance of light output.

Prior-art LEDs are often formed into a strip configuration that can have any length. These are often seen as flexible strands of lights used in holiday decorations, advertising, and emergency lighting. Other arrangements include flexible, rigid or semi-rigid printed circuit boards (PCBs) to which are affixed a plurality of LEDs. The PCBs are mounted into tracks that can be secured to surfaces, such as walls, the undersurface of kitchen cupboards, and the like. The tracks are available in various predetermined lengths, which can be joined end-to-end to form a continuous lighting arrangement of a desired length.

Mud-in recessed light fixtures are common in the market, but have traditionally adopted rigid polymeric lenses, either as flat sheets that attach via a slide fit, or as extruded profiles that attach via a snap fit.

Silicone extrusion is a well-known technology that is used to produce a variety of products including medical grade tubing, flexible jackets to protect lighting strips from water ingress and other linear products that are designed in profile.

LED tape light or flexible light engine is a relatively ubiquitous product comprised of surface mount LED packages, resistors or other current limiting devices and a flexible printed circuit board (FPCB). In the vast majority of products, a double-sided adhesive tape is pre-installed onto a backside of the FPCB as a means of mounting the light strip to a mounting surface.

SUMMARY

In view of the foregoing disadvantages inherent in the known types of light fixtures and lenses now present in the prior art, the present technology provides a novel luminaire lens and housing system, and overcomes one or more of the disadvantages and drawbacks of the prior art. As such, the general purpose of the present technology, which will be described subsequently in greater detail, is to provide a new and novel luminaire lens and housing system and method which has all the advantages of the prior art mentioned heretofore and many novel features that result in a luminaire lens and housing system which is not anticipated, rendered obvious, suggested, or even implied by the prior art, either alone or in any combination thereof.

According to one aspect of the present technology, the present technology essentially includes a light strip cover comprising a lens body including an interior section and at least one sidewall. The interior section can be configured to contact and apply mechanical pressure to at least one light strip that is fitted to a luminaire housing when at least a portion of the interior section and/or the sidewall is mounted to the luminaire housing.

According to another aspect of the present technology, a light strip system can comprise a luminaire housing including at least one mounting bracket, at least one light strip attachable to said mounting bracket, and an elongated lens body mountable to the mounting bracket. The lens body can include a top section, an interior section and at least two sidewalls. The interior section can be configured to contact and apply mechanical pressure to the light strip when at least said interior section and/or said sidewalls is mounted to said mounting bracket.

According to yet another aspect of the present technology, a light strip system can comprise a luminaire housing featuring at least two flanged side members, and at least two flanged end members. The flanged side members and the flanged end members can each having a configuration capable of being connected together to form said luminaire housing. The light strip system can have at least one mounting bracket having a generally U-shape configuration including a web section and side flange sections opposite each other. The side flange sections cane each feature at least one longitudinal protrusion that is receivable in a longitudinal groove defined in a flange side of said flanged side members of said luminaire housing, respectively. The light strip system can have at least one light strip attachable to the web section of said mounting bracket so said light strip is in an interior of said U-shape configuration. The light strip system can have an elongated lens body mountable to said mounting bracket. The lens body can include a top section, an interior section and at least two sidewalls. The interior section can be configured to contact and apply mechanical pressure to said light strip when at least said interior section and/or said sidewalls is mounted to said mounting bracket.

BRIEF DESCRIPTION OF THE DRAWINGS

The present technology will be better understood and objects other than those set forth above will become apparent when consideration is given to the following detailed description thereof. Such description makes reference to the annexed drawings wherein.

The same reference numerals refer to the same parts throughout the various figures.

DETAILED DESCRIPTION OF PREFERRED EMBODIMENTS

Figure 1:
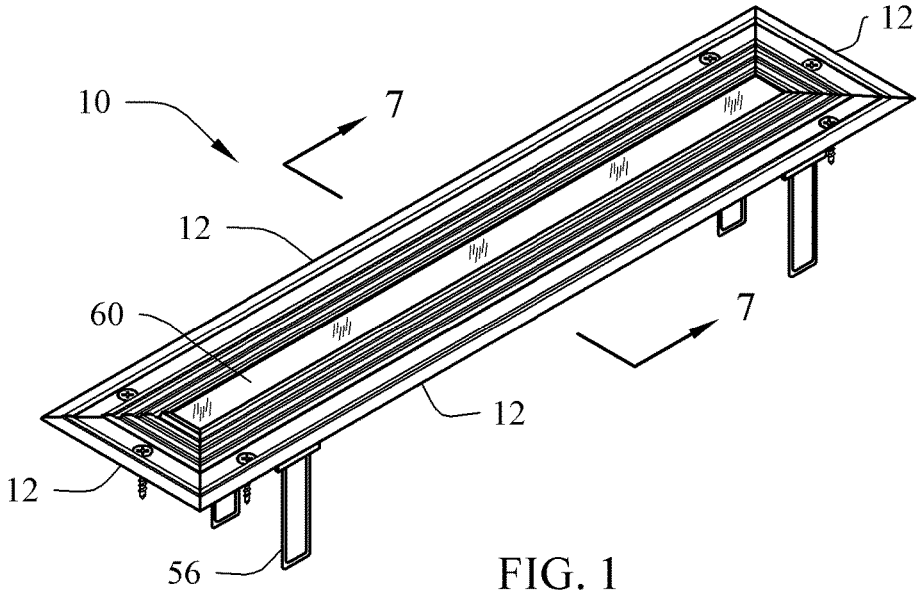
FIG. 1 is a perspective view of an embodiment of the luminaire lens and housing system constructed in accordance with the principles of the present technology, with the phantom lines depicting environmental structure and forming no part of the claimed invention.

In the following description, for purposes of explanation and not limitation, specific details are set forth, such as particular embodiments, procedures, techniques, etc. in order to provide a thorough understanding of the present technology. However, it will be apparent to one skilled in the art that the present technology may be practiced in other embodiments that depart from these specific details.

Present light fixtures use a rigid polymeric lens that mates with an aluminum or steel body of the fixture via a snap or slide fit. One of the principal design problems with these types of fixtures is that a rigid lens and housing necessitate a cut increment so the fixture can be shipped via express freight, truck freight and/or container freight methods. In most cases, this necessarily limits the length of the lens to 12 feet or under. Longer lenses could result in undesirable logistical problems and high freight costs. However, there are often cases where light fixtures are used in long, continuous runs that are far over 12 feet in length. To assemble a light fixture longer than the shipped length, multiple light fixtures must be installed in sequence, thereby creating seams between adjacent lenses. These individual lens sections and seams create undesired light distribution, unpleasant appearance, and increased installation time.

As described above, the vast majority of LED tape light products are held in place with a double-sided adhesive tape. While the tape typically works well when installed in controlled or lab conditions, containments such as dust, dirt or oil can counteract or inhibit the adhesive properties of the adhesive tape and cause the LED tape light to fall out of its intended mounting position once it is mounted. Additionally, heat produced by the LEDs themselves can degrade the adhesiveness of the tape. In lab conditions, a controlled amount of pressure is applied to the adhesive tape to allow it to properly wet to the mounting substrate. This is often not possible in the field given the complexities of architectural installations and the lack of proper training or tools. All of these factors make a mounting method based purely on adhesives somewhat unreliable and certainly not ideal for mission critical applications.

In traditional linear luminaire design, aluminum extrusion and sheet metal fabrication are the two main means of producing the luminaire housing. Aluminum extrusion provides benefits including finer profile details and production in continuous lengths with drawbacks such as longer lead times, tooling costs and the necessity of stocking extrusions for each individual luminaire design. Sheet metal fabrication has benefits such as short lead times and the ability to produce the exact amount of product needed from flat stock, rather than having to stock product for eventual use.

Drawbacks include a low level of detail in profile and the fact that the length of the fixture is dictated by the length of the metal working machinery used. When using the aluminum extrusion method to achieve fine detail and long lengths, stock levels can become very large since each luminaire housing will need to be stocked in sufficient quantity to fulfill any order that may be received. A company could have multiple housing designs, tying up cash and space, which are both precious resources in any business.

Current industry practices rely primarily on either double sided tape to secure the light strip to the fixture, small straps screwed over top of the light strip, or a snap fit of the light strip into a housing which is accomplished by jacketing the FPCB in a polymeric material to provide the dimensional stability needed to snap into some sort of channel.

While the above-described devices fulfill their respective, particular objectives and requirements, the aforementioned devices or systems do not describe a luminaire lens and housing system that allows mechanical fastening of a LED tape to a light fixture housing via a lens. The present technology additionally overcomes some of the disadvantages associated with the prior art by that the mounting mechanism is inherent to the lens design, no additional components (straps, screws, etc.) are required. Additionally, unlike the snap fit method, it is not necessary to jacket the FPCB of the present technology in polymeric materials, which saves cost and allows for a smaller shipping size.

A need exists for a new and novel luminaire lens and housing system that can be used for mechanical fastening of a LED tape to a light fixture housing via a lens body. In this regard, the present technology substantially fulfills this need. In this respect, the luminaire lens and housing system according to the present technology substantially departs from the conventional concepts and designs of the prior art, and in doing so provides an apparatus primarily developed for the purpose of mechanical fastening of a LED tape to a light fixture housing via a lens body.

Technical features described in this application can be used to construct various embodiments of light strip systems and covers. A light strip cover can comprise a lens body. The lens body can include an interior section and at least one sidewall. The interior section can be configured to contact and apply mechanical pressure to at least one light strip that is fitted to a luminaire housing when at least a portion of the interior section and/or the sidewall is mounted to the luminaire housing.

In some embodiments of the approach, the lens body can include at least one leg protruding from the interior section and/or the sidewall. The leg can have a configuration capable of being received in a depression defined in the luminaire housing. Alternatively, the leg can be at least two legs located on opposite sides of the lens body, and can have a configuration capable of retaining the lens body in the luminaire housing and exerting a downward force on the light strip when the legs are received in their corresponding depression.

In some embodiments, the sidewall is a plurality of sidewalls, and the leg is a first leg extending exterior of a first of the sidewalls and receivable in the depression, and a second leg extending exterior of a second of the sidewalls and receivable in a second depression defined in the luminaire housing.

In some aspects, the first leg and the second leg have a configuration capable of retaining the lens body in the luminaire housing and exerting a downward force on the light strip when the first leg is received in the depression and the second leg is received in the second depression of the luminaire housing.

In some aspects of the embodiments, the interior section convergingly tapers away from the sidewalls to a side of the interior section.

In some embodiments, the present technology can use a flexible, extruded, polymeric lens body to accomplish secure mounting of an LED tape, string or engine in a linear luminaire thereby removing lens seams. The lens body can be made of a transparent or translucent material. At least a portion of the lens body has a configuration capable of being compressed to be receivable in the luminaire housing.

In some aspects, a groove can be defined along a longitudinal length of the lens body. The groove can have a configuration corresponding to a portion of the light strip that is in contact with the interior section.

In some embodiments, the present technology can use a lens to apply mechanical pressure to the LED tape light in order to permanently hold it onto the mounting surface or an inside of an aluminum channel. The LED tape light can still be produced with double sided tape to aid in installation and thermal conductivity between the FPCB and the mounting surface, but the lens provides a permanent backup should the adhesive weaken or fail.

In another approach, the present technology can incorporate a modular nature of the luminaire housing allowing multiple configurations to be built out of the same base parts. The present technology can use a modular system of mating aluminum extrusions and accessories as building blocks, allowing multiple luminaire housings to be constructed from a number of different components. This approach increases installation speed, configurability and low inventory benefits, while also retaining the ability to create fine detail and long lengths inherent in extrusion process.

In still another approach, the present technology provides a light strip system including a modular luminaire housing, a mounting bracket, at least one light strip attachable to the mounting bracket, and a lens body. The luminaire housing can include at least two flanged side members, and at least two flanged end members all sharing a similar cross-sectional profile. The flanged side members can feature a groove capable of receiving a protrusion of the mounting bracket. The lens body can be mountable to the mounting bracket to contact and apply mechanical pressure to the light strip.

In some embodiments of the approaches, the luminaire housing is a plurality of modular extruded members having a configuration capable of being connected together to form said luminaire housing.

In some aspects, the mounting bracket can have a general U-shape configuration, and wherein at least a portion of the lens body has a configuration capable of being compressed to be receivable in an interior of the U-shape configuration of the mounting bracket.

In further aspects, the U-shape configuration of the mounting bracket can include a web section and side flange sections opposite each other. The side flange sections can each feature at least one longitudinal protrusion that is receivable in a longitudinal groove defined in a flange side of the flanged side members of the luminaire housing, respectively.

In other aspects, the light strip can be attachable to the web section of the mounting bracket so the light strip is in an interior of the U-shape configuration.

There has thus been outlined, rather broadly, features of the present technology in order that the detailed description thereof that follows may be better understood and in order that the present contribution to the art may be better appreciated.

There are, of course, additional features of the present technology that will be described hereinafter and which will form the subject matter of the claims attached.

Numerous objects, features and advantages of the present technology will be readily apparent to those of ordinary skill in the art upon a reading of the following detailed description of the present technology, but nonetheless illustrative, embodiments of the present technology when taken in conjunction with the accompanying drawings.

As such, those skilled in the art will appreciate that the conception, upon which this disclosure is based, may readily be utilized as a basis for the designing of other structures, methods and systems for carrying out the several purposes of the present technology. It is, therefore, that the claims be regarded as including such equivalent constructions insofar as they do not depart from the spirit and scope of the present technology.

It is therefore an object of the present technology to provide a new and novel luminaire lens and housing system that has all of the advantages of the prior art light fixtures or lenses and none of the disadvantages. The present technology can overcome prior art disadvantages by adopting an extrusion method for production of the lenses. This creates a flexible lens of essentially unlimited length that can be shipped in a roll rather than stretched out straight. Shipping in a roll allows much longer lengths of lens to be shipped, which in turn allows the end user to achieve a seamless surface once the product is installed. Additionally, the lens is easily cuttable in the field with a razor blade so that an installer can cut the lens to exactly the right length as field conditions change.

It is another object of the present technology to provide a new and novel luminaire lens and housing system that may be easily and efficiently manufactured and marketed.

An even further object of the present technology is to provide a new and novel luminaire lens and housing system that has a low cost of manufacture with regard to both materials and labor, and which accordingly is then susceptible of low prices of sale to the consuming public, thereby making such luminaire lens and housing system economically available to the buying public.

Still another object of the present technology is to provide a new luminaire lens and housing system that provides in the apparatuses and methods of the prior art some of the advantages thereof, while simultaneously overcoming some of the disadvantages normally associated therewith.

Even still, another object of the present technology is to provide a luminaire lens and housing system for mechanical fastening of a LED tape, strip, string or engine to a light fixture housing via a lens. This allows a continuous lens without any seams, while exerting a downward force on the light strip thereby securing the light strip to the light fixture housing.

These together with other objects of the present technology, along with the various features of novelty that characterize the present technology, are pointed out with particularity in the claims annexed to and forming a part of this disclosure. For a better understanding of the present technology, its operating advantages and the specific objects that can be attained by its uses, reference should be made to the accompanying drawings and descriptive matter in which there are illustrated embodiments of the present technology.

Whilst multiple objects of the present technology have been identified herein, it will be understood that the claimed present technology is not limited to meeting most or all of the objects identified and that some embodiments of the present technology may meet only one such object or none at all.

Referring now to the drawings, and particularly to FIGS. 1-10, an embodiment of the luminaire lens and housing system of the present technology is shown and generally designated by the reference numeral 10.

Figure 2:
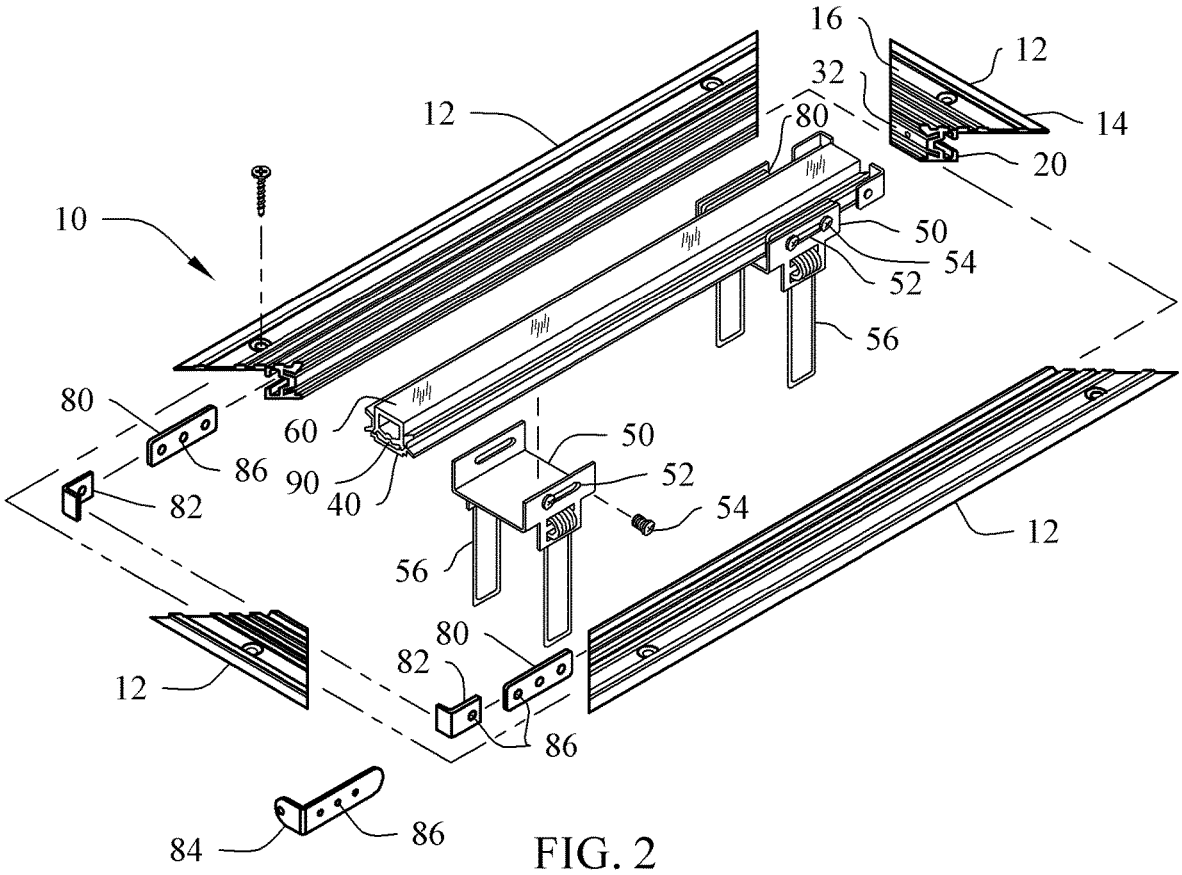
FIG. 2 is an exploded perspective view of the luminaire lens and housing system of the present technology.

In FIGS. 1 and 2, a new and novel luminaire lens and housing system 10 of the present technology for mechanical fastening of a light strip to a light fixture housing via a lens is illustrated and will be described. More particularly, the luminaire lens and housing system 10 can have a luminaire housing 12, a mounting bracket 40 attachable with the luminaire housing 12, a lens body 60 mountable to the mounting bracket 40, and at least one light strip 90 secured to the luminaire housing 12 or the mounting bracket 40. A portion of the lens body 60 can be in contact with a portion of the light strip 90. It can be appreciated that the light strip 90 can be, but not limited to, at least one of light source, at least one LED light source, a LED tape, LED strip, a LED engine, or a PCB including at least one LED light source.

The luminaire housing 12 can utilize a modular system of mating aluminum extrusions and accessories as building blocks, allowing multiple luminaire housings to be constructed from a number of different components of the same extruded profile, as best illustrated in FIG. 2. This method harnesses some of the speed, configurability and low inventory benefits of sheet metal fabrication while also retaining the ability to create fine detail and long lengths inherent in the aluminum extrusion process.

The extruded luminaire housing sections 12 can be cut to a desired length and assembled at their edges to form a luminaire housing fixture of any desired shape, length, width or configuration. For exemplary purpose, the extruded luminaire housing sections 12 can be cut at with 45° ends, and then assemble at these ends to form a rectangular or square luminaire housing fixture.

The luminaire lens and housing system 10 can be secured to a surface, wall, paneling, ceiling and the like by way of a spring arms 56 in operable association with a securing bracket 50, as best illustrated in FIG. 2. It can be appreciated that other securing means, systems and/or methods can be used in place of the securing bracket 50 and spring arms 56.

Figure 3:
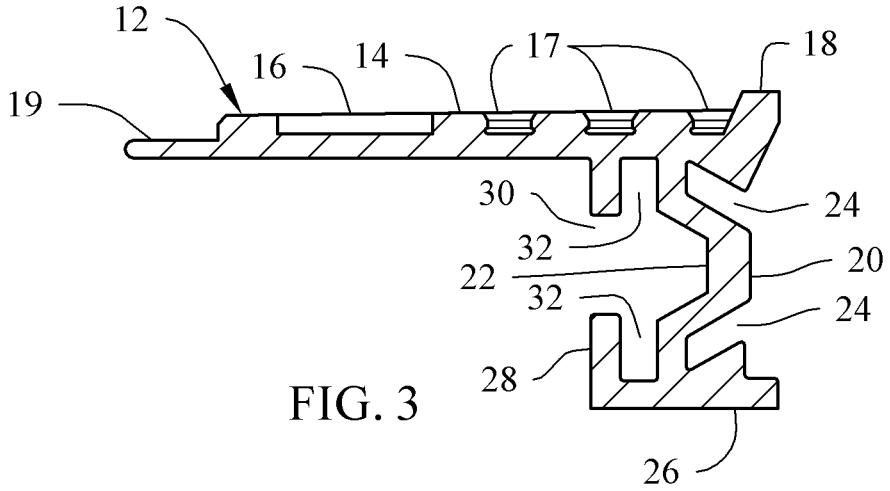
FIG. 3 is a cross-sectional view of the flanged side member of the luminaire housing of the present technology.

FIG. 3 depicts the extruded luminaire housing section 12 that can include a first section 14 and a flanged side section 20. The first section 14 can include a longitudinal first groove 16, a plurality of longitudinal second grooves 17, a first edge 18 that can transition to the flanged side section 20, and a second edge 19. The flanges side section 20 extends from the first section 14 at an angle, such as but not limited to, perpendicular from the first section 14. The first and second grooves 16, 17 can be defined in an exterior side of the first section 14 with an interior side being opposite thereof. The first groove 16 can further include a plurality of mounting holes configured to receive a mounting screw or fastener to secure the luminaire housing 12 to a surface. The second edge 19 can have a thickness less than that of the remaining first section 14 so as to provide a smoother and flush-like transition with the surface mounted therewith. Optionally, a compound or mudding can be utilized covering the second edge 19 and a portion of the surface adjacent therewith, to provide a smooth and flush transition.

The flanged side section 20 can include a first sidewall 22, a second sidewall 28, and a terminus side 26 spanning between the first and second sidewalls 22, 28. The first sidewall 22 can include a pair of longitudinal mounting grooves 24 defined by angle walls that can be convergingly or divergently angled with relation to each other. A flat planar section of the first sidewall 22 can span between the angle walls that define the mounting grooves 24.

The terminus side 26 of the flanged side section 20 can be in a spaced apart relationship with the first section 14. Optionally, the terminus side 26 can be substantially parallel with the first section 14.

The second sidewall 28 can span between the interior side of the first section 14 and the terminus side 26. A longitudinal slot 30 can be defined in the second sidewall 28. The second sidewall 28 can be spaced apart from the first sidewall 22 thereby defining a longitudinal interior cavity 32.

To assemble the luminaire housing sections 12, a joiner bracket 80, 82, 84 can be used at each cut end. The joiner bracket 80, 82, 84 can include a first portion receivable in the interior cavity 32 of a first luminaire housing section 12, and a second portion receivable in the interior cavity 32 of an adjacent second luminaire housing section 12. The joiner bracket 80, 82, 84 can include an angled section allowing for adjacent luminaire housing sections 12 to be connected at different angles, thereby creating a light housing fixture with multiple sides and configurations.

Set screws, received through holes 86 defined in the joiner brackets 80, 82, 84, can be used to secure the brackets to their respective luminaire housing section 12. With the cut ends of the luminaire housing sections 12 secured together, a perimeter is formed creating the general shape of the luminaire lens and housing system 10. For exemplary purposes, this general shape can include at least two side luminaire housing sections 12, and at least two end luminaire housing sections 12, as best illustrated in FIGS. 1 and 2.

Figure 4:
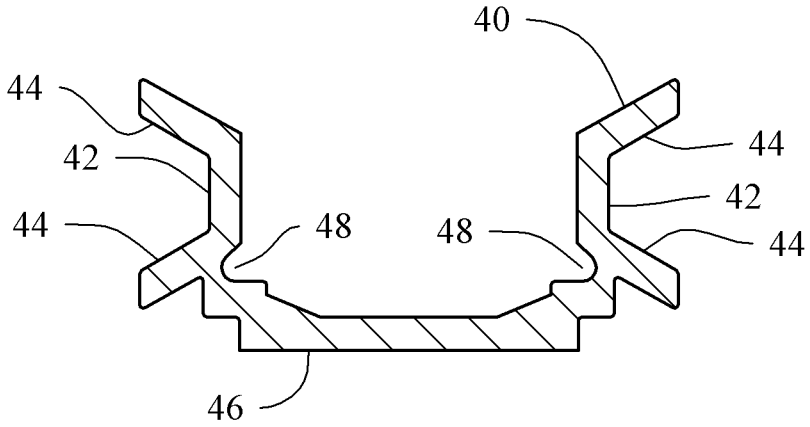
FIG. 4 is a cross-sectional view of the mounting bracket of the luminaire housing of the present technology.

Referring now to FIG. 4, one embodiment of the mounting bracket 40 can have a generally U-shape configuration including a web section 46 and side flange sections 42 opposite each other, with the web section 46 spanning between the side flange sections 42. The side flange sections 42 each can include a pair of longitudinal protrusions 44 extending out therefrom, and which are receivable in the mounting groove 24 of the flange section 20 of the luminaire housing 12. The protrusions 44 can be convergingly or divergently angled with relation to each other, so as to match the angled configuration of their respective mounting groove 24. The side flange sections 42 can be a flat planar section that spans between the protrusions 44.

The protrusions 44 of one of the side flange sections 42 can be received in the mounting grooves 24 of a first of the side luminaire housing sections 12, and the protrusions 44 of the other side flange section 42 can be received in the mounting grooves 24 of a second of the side luminaire housing sections 12.

A longitudinal depression 48 can be defined in an interior side of each of the side flange sections 42, in the web section 46 or in an area defining a transition between the side flange sections 42 and the web section 46.

Figure 5:
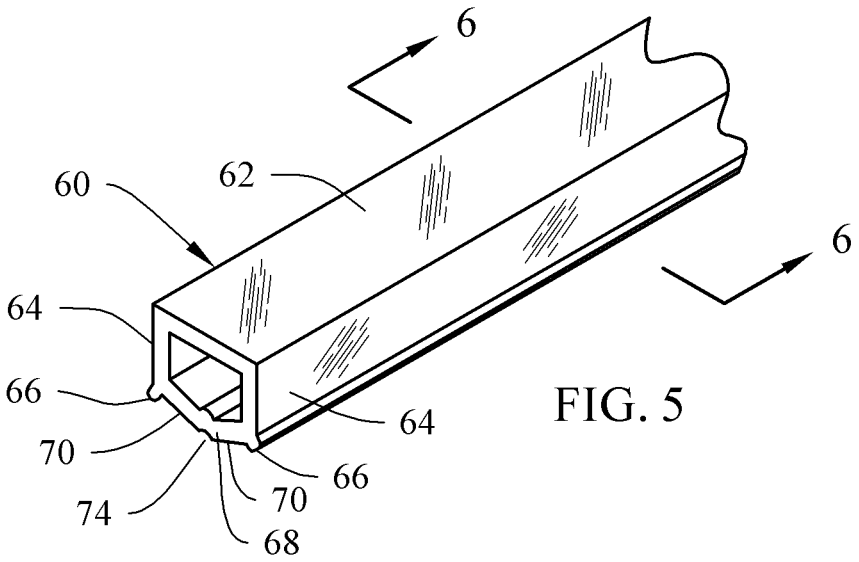
FIG. 5 is a perspective view of the lens body of the present technology.
Figure 6:
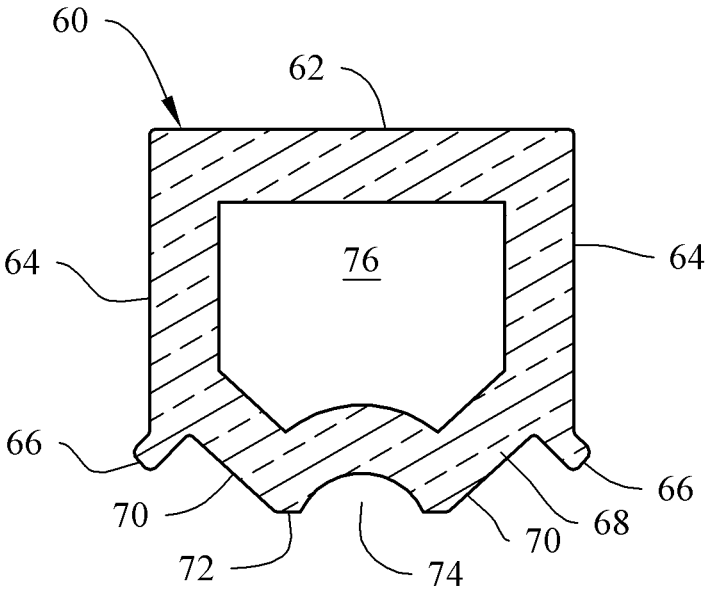
FIG. 6 is a cross-sectional view of the lens body taken along line 6-6 in FIG. 5.

FIGS. 5 and 6 depict an embodiment of the lens body 60 that can have a configuration capable of being mountable in an interior of the general U-shape configuration of the mounting bracket 40. The lens body 60 can be a flexible lens made of a transparent or translucent material capable of diffusing, dispersing and/or transmitting light from the light strip 90, securing the light strip 90 to the mounting bracket 40, and to provide a continuous lens without seams. The lens body 60 can be, but not limited to, made from extruded polymeric or silicon material, thereby producing a continuous length of the lens body 60 that can be rolled for storage or transport.

The lens body 60 can include a top section 62, an interior section 68 and at least two sidewalls 64, thereby forming an enclosed profile with a hollow interior 76 running along a longitudinal length of the lens body 60. It can be appreciated that the top section 62 and the sidewalls 64 can be integrally formed as a single rounded or polygonal side. The top section 62 can be, but not limited to, flat, arcuate, rounded or polygonal. It can further be appreciated that any part of the lens body 60 can include ridges, grooves, protrusions and/or recesses capable of altering light transmission passing therethrough.

The interior section 68 can include a pair of sides 70 that convergingly tapers away from the sidewalls 64 to an interior side 72. At least one longitudinal recess 74 can be defined in the interior side 72 or formed by an arcuate section extending into the hollow interior 76. The interior section 68, the interior side 72 and/or the recess 74 can have a configuration capable of contacting and applying mechanical pressure to a portion of the light strip 90 when at least the interior section 68 and/or said sidewalls 64 are mounted in the mounting bracket 40.

The lens body 60 can further include at least one leg 66 extending exterior of at least one of the sidewalls 64. The leg 66 can be at least one first leg 66 extending from a first of the sidewalls 64, the interior section 68 or from a section transitioning between the first sidewall 64 and the interior section 68, and at least one second leg 66 extending from a second of the sidewalls 64, the interior section 68 or from a section transitioning between the second sidewall 64 and the interior section 68.

Figure 7:
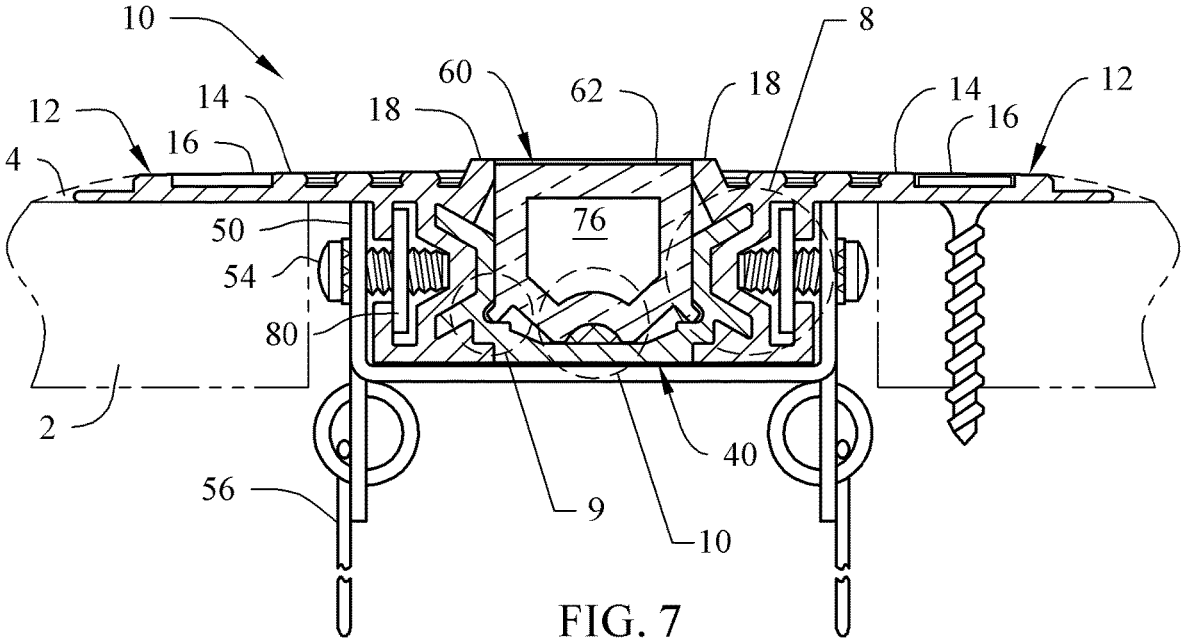
FIG. 7 is a cross-sectional view of the luminaire lens and housing system taken along line 7-7 in FIG. 1.

Referring now to FIG. 7, the luminaire lens and housing system 10 is depicted as assembled and mounted to a surface 2. The second edge 19 can be configured to create flush-like transition with the surface 2, with the optional utilization of a compound or mudding 4 to further create a flush transition with the luminaire housing 12.

The top section 62 of the lens body 60 can be flush, protruding or recessed with relation to the first edge 18 of the first sections 14 of the luminaire housings 12 adjacent therewith.

Figure 8:
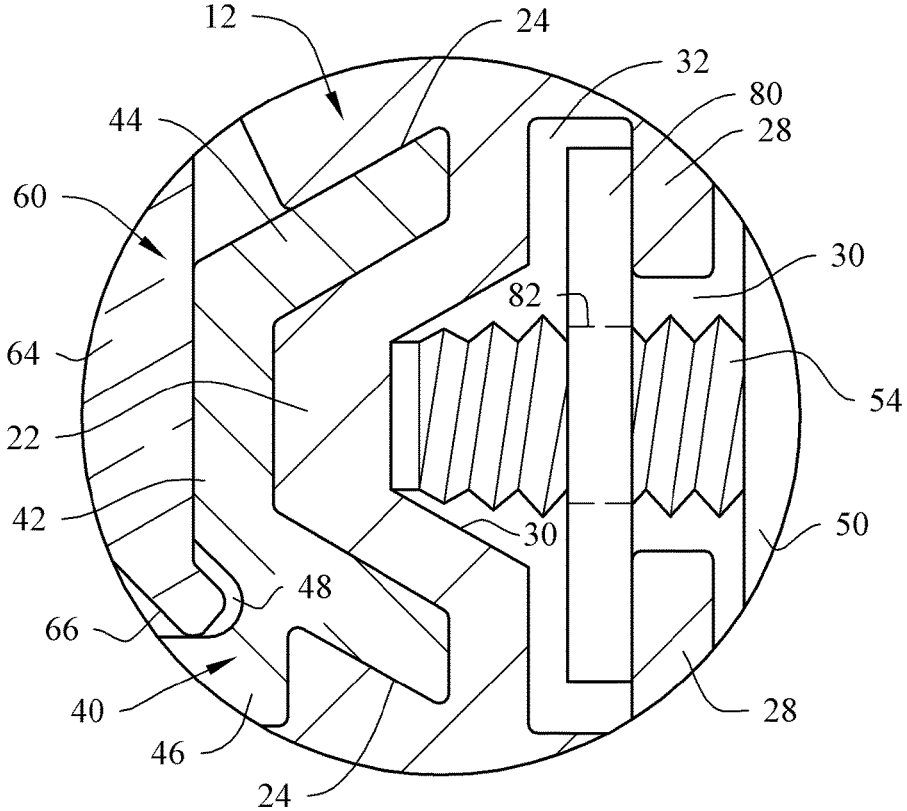
FIG. 8 is an enlarged cross-sectional view of the mounting bracket assembled with the luminaire housing taken from FIG. 7.

When assembled, as best illustrated in FIG. 8, the protrusions 44 of the mounting bracket 40 are received in their corresponding mounting groove 24 of the flanged side section 20 of the luminaire housing 12. The joiner bracket 80, 82, 84 can be inserted into the interior cavity 32 of the flanged side section 20 of each of the side luminaire housing sections 12.

The securing bracket 50 can have a generally U-shape configuration including a pair of sidewalls and a web section spanning the sidewalls. The securing bracket 50 can be positioned so that an interior of its U-shape configuration receives the flanged side sections 20 of the assembled side luminaire housing sections 12, and the mounting bracket 40. A slot 52 can be defined through each of the sidewalls of the securing bracket 50.

A threaded portion of a set screw 54 can be received through the slot 52, and received through the longitudinal slot 30 of the second sidewall 28 of the flanged side section 20 of the luminaire housing 12, respectively. The threaded portion of the set screw 54 can be threadably engaged with one of the holes 86 of the joiner bracket 80, 82, 84. An end of the set screw 54 can have a configuration capable of contacting and applying mechanical pressure against a portion of the first sidewall 22 of the flanged side section 20 of the luminaire housing 12, respectively. It can be appreciated that a separate joiner bracket 80 can be used independent of other joiner brackets 82, 84, to allow the positioning of the separate joiner bracket 80 and its corresponding securing bracket 50 to be independent of the other joiner bracket 82, 84 used to connect adjacent luminaire housing sections 12.

Tightening of the set screw 54 advances its end against the first sidewall 22 of the luminaire housing 12, while moving the joiner bracket 80, 82, 84 against the second sidewall 28, thereby clamping the second sidewall 28 between the joiner bracket 80, 82, 84 and the sidewall of the securing bracket 50. It can be appreciated that continued tightening of the set screw 54 could apply a mechanical clamping force to the lens body 60 positioned in the mounting bracket 40 due to the inward movement of at least one of the side flange sections 42.

Figure 9:
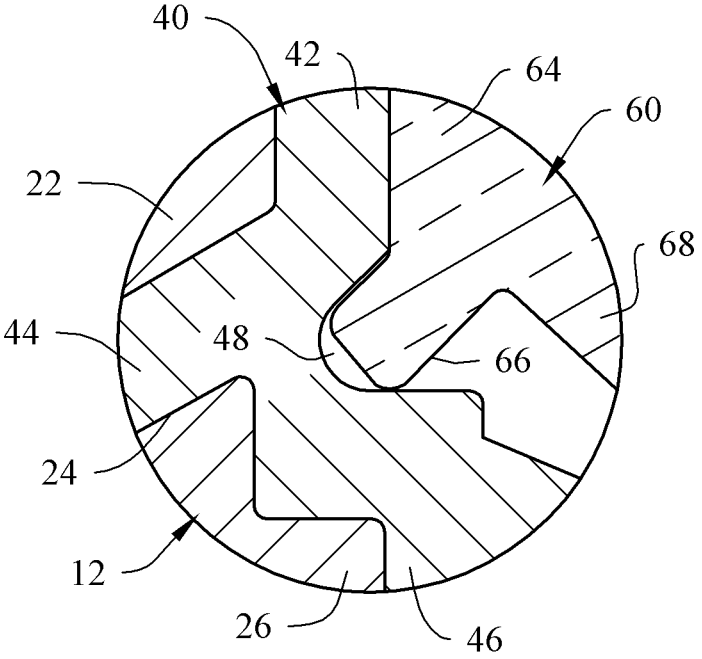
FIG. 9 is an enlarged cross-sectional view of the leg of the lens body received in the depression of the mounting bracket taken from FIG. 7.

Referring to FIG. 9, the engagability of the leg 66 and its corresponding depression 48 is depicted. Each leg 66 can have a configuration capable of being received in a corresponding depression 48 of the mounting bracket 40. In addition, each leg 66 can have a configuration capable of retaining the lens body 60 in the mounting bracket 40 and exerting a downward force on the light strip 90 when said first leg 66 and said second leg 66 are received in their corresponding depression 48, respectively.

The flexibility of the lens body 60 provides for at least the sidewalls 64 and/or the interior section 68 to deform, thereby allowing the leg 66 to be manipulated and inserted into the depression 48. Each leg 66 can be angled away from its respective sidewall 64, and can feature a rounded, pointed or flat end. The configuration of the leg 66 and/or the depression 48 can be configured to apply a predetermined amount of downward force to the light strip 90 when the lens body 60 is assembled with the mounting bracket 40.

This downward force can be created by a distance of the leg 66 to the interior side 72 is greater than a distance of the depression 48 to an exterior side of the light strip 90. This difference in distance results in a surface of the depression 48 pressing against an adjacent surface of the leg 66, which forces the leg 66, and consequently the interior section 68 toward the light strip 90. It can be appreciated that the size and/or configuration of the legs 66, the groove 74 and/or the interior section 68 can be changed to allow for different sized light strips 90 and/or different amounts of downward force.

It can also be appreciated that the depression 48 can have a dimension larger than the leg 66 or portion thereof, to allow movement of the leg 66 within the depression 48.

Further referencing FIG. 9, the terminus side 26 of the second section 20 of the luminaire housing 12 can include at least one ledge capable of abutting against a ledge of the web section 46 of the mounting bracket 40 when assembled. These ledges can provide additional rigidity and/or securement of the assembled luminaire housing 12 and mounting bracket 40.

Figure 10:
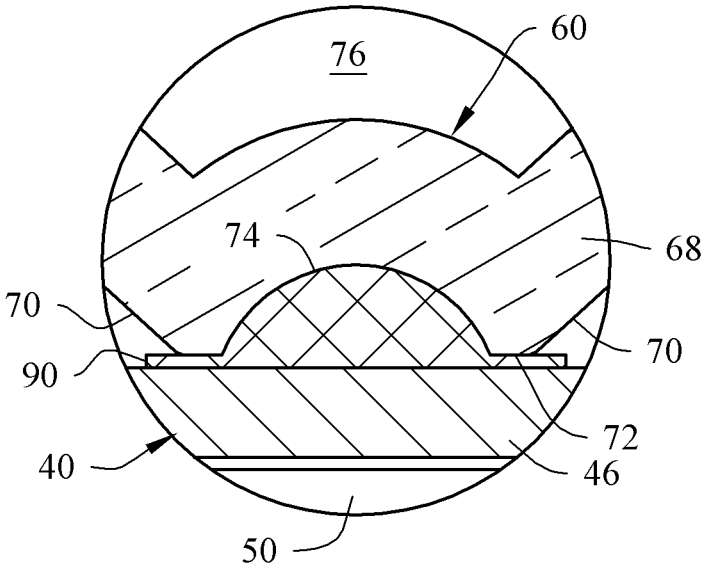
FIG. 10 is an enlarged cross-sectional view of the interior side of the lens body contacting the light strip taken from FIG. 7.

Referring to FIG. 10, the engagability of the interior section 68 of the lens body 60 and the light strip 90 is depicted. The light strip 90 can initially be secured to the web section 46 of the mounting bracket 40 by way of an adhesive or double sided tape.

The lens body 60 can be inserted into the interior of the mounting bracket 40 so that the legs 66 are received in their corresponding depression 48, and so that the recess 74 of the lens body 60 receives a portion of the light strip 90. The configuration of the leg 66 and depression 48 engagement produces a downward force of the interior section 68 of the lens body 60 against the light strip 90. This downward force mechanically secures the light strip 90 with the mounting bracket, and provides at least the following advantage of allowing the adhesive or tape to set, and/or providing a permanent backup, should the adhesive or tape weaken or fail.

In use, it can now be understood that the luminaire lens and housing system 10 can be used as a mud-in recessed light fixture utilizing a seamless lens body 60 for improved securement of the light strip to the luminaire housing 12 or mounting bracket 40 associated therewith. Additionally, the modular nature of the luminaire housings allow for multiple configurations to be built out of the same extruded luminaire housing sections.

For exemplary purposes, the extruded luminaire housing sections can be cut at angles to create a predetermined assembled configuration that is to be mounted to a surface. The mounting bracket can be assembled with the luminaire housing sections that are too utilized as the sides of the assembled configuration. The mounting bracket is assembled with the side luminaire housing sections by inserting or sliding the protrusions of the side flange section of the mounting bracket with the corresponding groove of the flange section of the luminaire housing, respectively.

The light strip can be secured to an interior side of the web section of the mounting bracket prior to or after assembling the mounting bracket with the luminaire housing.

After the light strip is secured to the web section, the lens body can be manipulated so its interior section is inserted into the interior of the mounting bracket until the legs are received in their corresponding depressions of the mounting bracket. The configuration of the legs and depressions force the interior section of the lens body against the light strip, thereby mechanically securing the light strip to the mounting bracket.

A portion of at least one joiner bracket can be inserted into the interior cavity of the side luminaire housing sections, and another portion of the joiner bracket can be inserted into the interior cavity of an adjacent end luminaire housing section. It can be appreciated that varying procedural steps can be used to accomplish the assembling of the side and end luminaire housing sections.

The securing bracket can be slidably positioned to receive the flanged side sections of the assembled side luminaire housing sections and the mounting bracket. Set screws can be used to fasten the securing bracket to the luminaire housing by threadable engaging with at least one of the joiner brackets aligned with the set screws, respectively. Additional set screws can be used to secure further the assembled luminaire housing sections together and/or to additional joiner brackets.

A section of the surface can be cut that corresponds with at least a footprint dimension of the assembled flanged side sections of the assemble luminaire housing sections. The spring arms of the securing bracket are inserted through the surface cut out section, and the assembled luminaire housing section is placed so that the interior side of the first sections of the assembled luminaire housing sections contacts the surface, thereby recessing a portion of the assembled luminaire housing sections with the surface.

The spring arms can be biased so that that they pivot against the surface, and screws can be used to secure the first section of the assembled luminaire housing sections to the surface. Compound or mud can be used to cover the second edge of the first section of the luminaire housing and provide a flush or smooth transition with the surface.

The luminaire lens and housing system of the present technology has many advantages over known recessed light fixtures and lens covers. Some advantages of the lens body of the present technology are, but not limited to, a flexible seamless lens body, the mounting mechanism for the light strip is inherent to the lens body design so no additional components (straps, screws, etc.) are needed, and it is not necessary to jacket the FPCB or PCB in polymeric materials which saves cost and allows for a smaller shipping size.

Some advantages of using the extruded luminaire housing of the present technology are, but not limited to, providing modularity of luminaire housing components, expansion components to the luminaire housing can be utilized.

It can be appreciated that the light strip could be co-extruded into the lens body, significantly speeding up the installation process in the field. Furthermore, it can be appreciated that direct alternating current (AC) LED tape, high voltage direct current (DC) LED tape or rigid modules can be incorporated with the lens body or the mounting bracket.

The present technology can adopt an extrusion method for production of the lenses. This creates a flexible lens of essentially unlimited length that can be shipped in a roll rather than stretched out straight. Shipping in a roll allows much longer lengths of lens to be shipped, which in turn allows the end user to achieve a seamless surface once the product is installed. Additionally, the lens is easily cuttable in the field with a razor blade so that an installer can cut the lens to exactly the right length as field conditions change. Often the necessary length is not known when the lens is in production, or the required length changes due to the volatility of a construction environment.

While embodiments of the luminaire lens and housing system have been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present technology. For example, any suitable sturdy material may be used instead of the above-described. And although mechanical fastening of a LED tape to a light fixture housing via a lens have been described, it should be appreciated that the luminaire lens and housing system herein described is also suitable for providing modular components for a luminaire fixture or providing a continuous lens body that can be cut to a desired length creating a seamless lens body.

Further, since numerous modifications and changes will readily occur to those skilled in the art, it is not desired to limit the present technology to the exact construction and operation shown and described, and accordingly, all suitable modifications and equivalents may be resorted to, falling within the scope of the present technology.

What is claimed as being new and desired to be protected by Letters Patent of the United States is as follows:

1. A light strip cover comprising:

a lens body including an interior section and at least one sidewall, said interior section being configured to contact and apply mechanical pressure to at least one light strip that is fitted to a luminaire housing when at least a portion of said interior section and/or said sidewall is mounted to said luminaire housing, wherein said sidewall is further configured to contact a side flange of said luminaire housing and receive mechanical pressure from said luminaire housing; and at least one leg protruding from said interior section and/or said sidewall in a direction away from said interior section, said leg having a free end receivable in a depression defined in said luminaire housing.

2. The light strip cover according to claim 1, wherein said lens body defines an enclosed longitudinal cavity extending along a length of said lens body.

3. The light strip cover of claim 1, wherein said lens body is an extruded flexible polymeric lens composed of a transparent or translucent material.

4. The light strip cover according to claim 1, wherein said sidewall is a plurality of sidewalls, and said leg is a first leg extending exterior of a first of said sidewalls and receivable in said depression, and a second leg extending exterior of a second of said sidewalls and receivable in a second depression defined in said luminaire housing.

5. The light strip cover of claim 4, wherein said first leg and said second leg being configured to retain said lens body in said luminaire housing and exerting a downward force on said light strip when said first leg is received in said depression and said second leg is received in said second depression of said luminaire housing.

6. The light strip cover according to claim 5, wherein said interior section includes convergingly tapering sides extending from said sidewalls to an interior side of said interior section that extends from and between said convergingly tapering sides.

7. The light strip cover according to claim 6, wherein said interior section defines a groove along a longitudinal length of said lens body.

8. The light strip cover according to claim 7, wherein said groove has a configuration corresponding to a portion of said light strip, said groove being defined in a surface of said interior side that is at least in part in contact with at least a portion of said light strip.

9. The light strip cover according to claim 1, wherein at least a portion of said lens body being compressed to be receivable in said luminaire housing.

10. A light strip system comprising:

a luminaire housing including at least one mounting bracket;

at least one light strip attachable to said mounting bracket; and an elongated lens body mountable to said mounting bracket, said lens body including a top section, an interior section, and at least two sidewalls extending between said top section and said interior section to define an enclosed longitudinal cavity extending along a length of said lens body, said interior section being configured to contact and apply mechanical pressure to said light strip when at least said interior section and/or said sidewalls is mounted to said mounting bracket, wherein said sidewalls are each configured to contact a side flange of said luminaire housing and receive mechanical pressure from said luminaire housing, said lens body further including at least one leg protruding from said interior section and/or said sidewalls in a direction away from said interior section, said leg having a free end receivable in a depression defined in said luminaire housing or said mounting bracket.

11. The light strip system according to claim 10, wherein said luminaire housing is a plurality of modular extruded members connected together to form said luminaire housing.

12. The light strip system according to claim 10, wherein said light strip is a flexible light engine featuring light emitting diodes, and said lens body is an extruded flexible polymeric lens composed of a transparent or translucent material.

13. The light strip system according to claim 10, wherein said leg is a first leg extending exterior of said sidewalls and receivable in said depression, and a second leg extending exterior of a second of said sidewalls and receivable in a second depression in said mounting bracket.

14. The light strip system according to claim 13, wherein said first leg and said second leg being configured to retain said lens body in said mounting bracket and exerting a downward force on said light strip when said first leg is received in said depression and said second leg is received in said second depression of said mounting bracket.

15. The light strip system according to claim 10, wherein said interior section convergingly tapers away from said sidewalls to an interior side of said interior section, said interior side defines a groove therein and along a longitudinal length of said lens body, said groove has a configuration corresponding to a portion of said light strip that is in contact with said interior section.

16. The light strip system according to claim 10, wherein said mounting has a general U-shape configuration, and wherein at least a portion of said lens body is configured to be compressed so that said leg extending from said lens body is received in said depression defined in an interior of said U-shape configuration of said mounting bracket.

17. A light strip system comprising:

a luminaire housing featuring at least two flanged side members, and at least two flanged end members, said flanged side members and said flanged end members each being configured to be connected together to form said luminaire housing;

at least one mounting bracket having a generally U-shape configuration including a web section and side flange sections opposite each other, said side flange sections each featuring at least one longitudinal protrusion that is receivable in a longitudinal groove defined in a flange side of said flange side members of said luminaire housing, respectively;

at least one light strip attachable to said web section of said mounting bracket so said light strip is in an interior of said U-shape configuration; and an elongated lens body, including at least an interior section and at least two sidewalls, mountable to said mounting bracket, said lens body being configured to contact and apply mechanical pressure to said light strip when at least said interior section and/or said sidewalls is mount to said mounting bracket, wherein said sidewalls are each configured to contact a side flange of said luminaire housing and receive mechanical pressure from said luminaire housing.

18. The light strip system according to claim 17, wherein said lens body further comprising a first leg extending exterior of a first of said sidewalls, and a second leg extending exterior of a second of said sidewalls, said first leg being received in a depression defined in a first of said side flange sections of said mounting bracket, said second leg received in a depression defined in a second of said side flange sections of said mounting bracket, wherein said first leg and said second leg each being configured to retain said lens body in said mounting bracket and exerting a downward force on said light strip when said first leg and said second leg is received in said depression, respectively.

* * * * *